United States Patent [19]

Buttner

[11] 4,308,440

[45] Dec. 29, 1981

[54] SWITCH CONTACT POSITIONING ASSEMBLY

[76] Inventor: Horace J. Buttner, 1501 Palos Verdes Dr. North, Harbor City, Calif. 90710

[21] Appl. No.: 99,049

[22] Filed: Nov. 30, 1979

[51] Int. Cl.[3] ..... H01H 13/04

[52] U.S. Cl. ..... 200/303; 200/16 B; 200/159 A; 200/284

[58] Field of Search ..... 200/303, 159 A, 159 R, 200/16 B, 16 A, 280, 281, 284

[56] References Cited

U.S. PATENT DOCUMENTS

| | | | |
|---|---|---|---|
| 2,907,847 | 10/1959 | Grenier et al. | 200/16 A |
| 3,532,840 | 10/1970 | Bauer | 200/303 |
| 3,829,633 | 8/1974 | Smith et al. | 200/160 |
| 4,052,580 | 10/1977 | Stanish | 200/16 A |
| 4,055,736 | 10/1977 | Congelliere | 200/16 A |

*Primary Examiner*—Willis Little

*Attorney, Agent, or Firm*—Pollock, Vande Sande & Priddy

[57] ABSTRACT

A switch assembly of the type including a moveable contact and at least one additional contact having a free end lying generally across the line of travel of the moveable contact and having a further portion secured against movement within the switch assembly. A crushable rib is attached to a portion of the housing and is crushed into engagement with the further portion as the switch is assemblied. The invention also employs a pocket for securing a portion of the additional contact terminal against undesirable movement. A spring tab is employed for ensuring a good electrical connection between the moveable contact and a yet further contact terminal arranged within the switch.

11 Claims, 12 Drawing Figures

FIG. 1
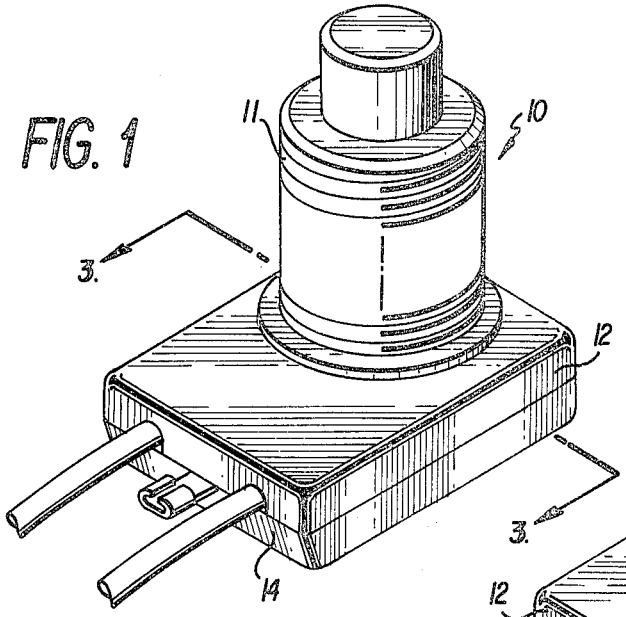
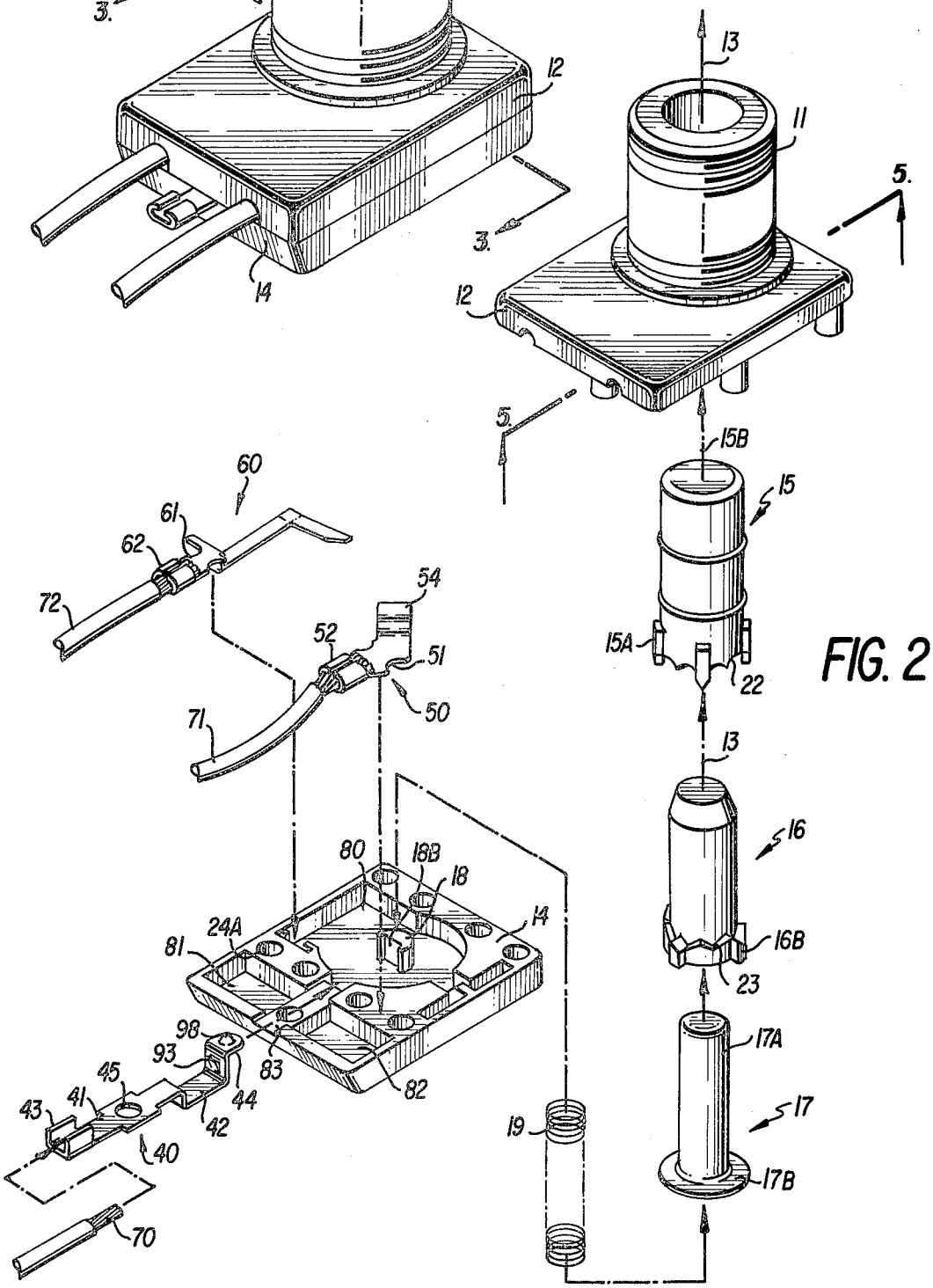
FIG. 2

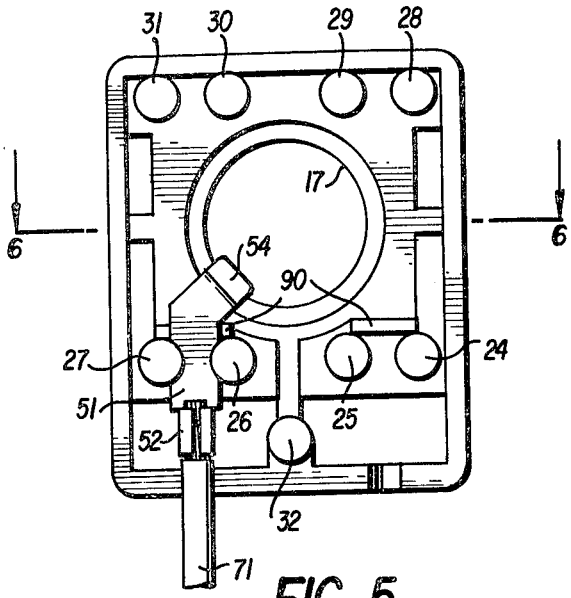
FIG. 5
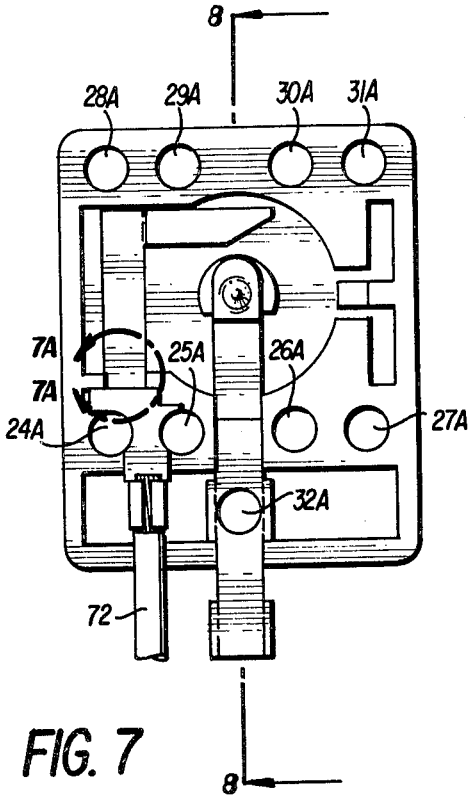
FIG. 7
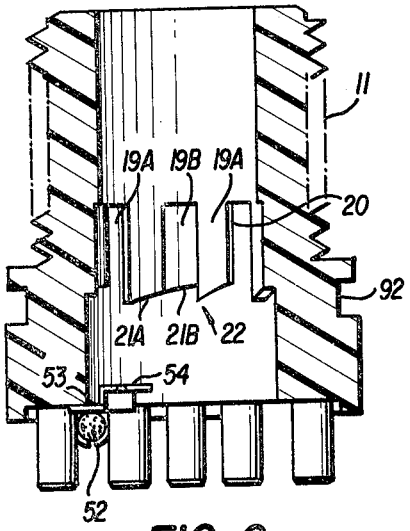
FIG. 6
FIG. 10A
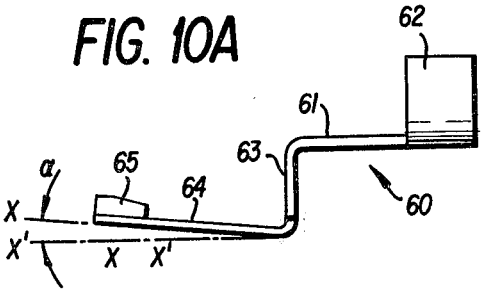
FIG. 10B
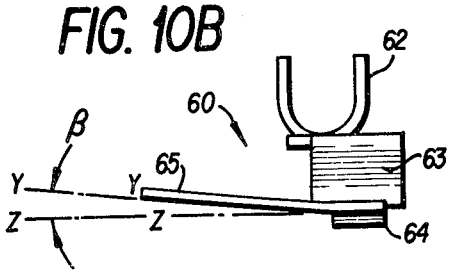

SWITCH CONTACT POSITIONING ASSEMBLY

DESCRIPTION

1. Technical Field

The present invention relates to a number of improvements for ensuring accurate positioning and/or proper electrical connection between electrical contacts in a switch.

2. Background Art

The present invention is directed to improvements in switch assemblies of the type including a moveable contact and at least one additional contact terminal each arranged within a switch housing. During operation, the moveable contact is projected along an axis extending through the switch into selective engagement with a free end of the contact terminal to establish an electrical connection therebetween. Such arrangements are commonly found, for example, in push-button switches.

Such switch assemblies have long been confronted with a variety of problems which adversely affect the operating efficiency of the switch. For example, bending stresses transmitted from the moveable contact to a free end of the contact terminal during repeated operations of the push-button actuator tend to misalign the contact terminal within the switch housing, preventing proper contact from being established. In addition, it has proven difficult to establish a continuous electrical connection between the moveable contact and a further contact terminal as required to provide an electrical circuit through such a push-button switch. Finally, such push-button switches generally require some type of biasing assembly for pressing the moveable contact in a predetermined direction along its line of travel. However, it has proven difficult to properly secure such biasing member within the switch housing, leading to jamming of the push-button mechanism.

As will become clear, the present invention is directed to improved switch assemblies which overcome one or more of the disadvantages inherent in known prior art assemblies, as discussed hereabove, as well as additional disadvantages confronting the prior art.

DESCRIPTION OF THE INVENTION

The present innvention provides a number of improvements to switches of the type generally discussed hereabove.

In a first aspect of the present invention, the switch includes a housing assembly comprising first and second housing members having confronting surface portions at least a portion of which are disposed in abutting contact with one another. A moveable contact is arranged for projection along an axis extending through the switch between first and second stable positions in which the moveable contact is in electrical contact with one or more contact terminals. At least one of the contact terminals includes a free end portion for contacting the moveable contact and for deflecting as the moveable contact moves toward one of the stable positions. The free end is connected with a further portion of the contact terminal, which further portion is fixedly mounted in the housing assembly at a sufficient distance from the free end to enable deflection of the free end.

A rib member formed of crushable material integral with at least one of the housing members projects into contact with and across the further portion of the at least one contact terminal. The rib member is crushed against the at least one contact terminal for maintaining the terminal fixedly positioned between the housing members as the free end deflects. It is considered within the scope of the present invention to employ a plurality of the crushable ribs, each positioned to secure one or more contact terminals between the abutting housing members.

In another aspect of the invention, an assembly is arranged for maintaining proper positioning of an electrical contact terminal with the switch housing. A moveable contact is arranged for projection along an axis extending through the switch and a contact terminal is arranged in a predetermined location in the switch for selective engagement with the moveable contact when the moveable contact reaches a predetermined position along the axis. The contact terminal comprises a plurality of attached portions, with at least two of the portions extending in at least one plane lying generally across the line of travel of the moveable contact and having longitudinal axes forming a sufficient angle to one another, whereby one of the portions, when deflected, can cause torsional strain in at least one of the remaining portions of the contact terminal. A pocket is arranged in the switch housing for enclosing and immobilizing a further portion of the contact terminal to maintain the plurality of attached portions in their predetermined locations prior to deflection by the moveable contact.

In another aspect of the invention, a further assembly is arranged for maintaining accurate positioning of an electrical contact terminal in a switch of the type including a moveable contact and first and second contact terminals. The moveable contact is arranged for projection along an axis extending through the switch housing and the first contact terminal is arranged for selectively electrically engaging the moveable contact when the moveable contact reaches a predetermined position along the axis. The second contact terminal is arranged for providing substantially continuous engagement with the moveable contact to selectively provide an electrical circuit between the first and second contact terminals. A post member extends within a recess formed in the switch and includes a notch or slot arranged for receiving a portion of the second contact terminal to maintain the second contact terminal in proper alignment relative to the moveable contact.

In another aspect of the invention, an assembly is arranged for maintaining proper electrical contact between a pair of relatively moveable electrical contacts arranged within a switch assembly. A moveable contact is arranged for projection along an axis extending through the switch. The moveable contact includes interior wall means extending about a space which is at least partially enclosed by the wall means. A first contact terminal is positioned for providing substantially continuous electrical engagement with the moveable contact. The first contact terminal includes a portion projecting into the space at least partially enclosed by the interior wall means of the moveable contact, with said portion having a spring tab extending into sliding engagement with the interior wall means to provide electrical connection therebetween. A second contact terminal is positioned for selective engagement with the moveable contact when the moveable contact reaches a predetermined position along the axis.

In another aspect of the invention, an assembly is arranged for positively locating an engagement spring between a pair of relatively moveable electrical contacts arranged within a switch housing assembly, wherein a moveable contact is arranged for projection along an axis extending through the switch. The moveable contact includes interior wall means extending about a space which is at least partially enclosed by the wall means. A first contact terminal is positioned for providing substantially continuous electrical engagement with the moveable contact and a second contact terminal is positioned for providing selective engagement with the moveable contact when the moveable contact reaches a predetermined position along the axis. A coil spring extends between a portion of the first contact terminal and the space within the moveable contact, with the coil spring engaging the interior wall means to bias said moveable contact along the axis. A projection member extends from the portion of the first contact terminal into the coil spring for preventing inadvertent misalignment of the coil spring relative to the first contact terminal.

The unique structural characteristics of the present invention enable the production of compact assemblies requiring a minimum of actuating force, due to the unique design of the various components included within the switch housing assembly.

BRIEF DESCRIPTION OF THE DRAWINGS

A preferred embodiment of the present invention will now be described in more detail in the following portions of this specification when taken in conjunction with the attached drawings in which like reference characters identify identical apparatus, and in which:

FIG. 1 is a perspective view of a push-button switch assembly incorporating a preferred embodiment of the present invention;

FIG. 2 is an exploded view of the switch assembly of FIG. 1;

FIG. 5 is a sectional view of the head portion of the switch assembly;

FIG. 6 is a cross-section of the head member taken on lines 4—4 in FIG. 5;

FIG. *7a* is an isolated view of a contact retaining pocket formed in the switch core of FIG. 7.

Figure 3:
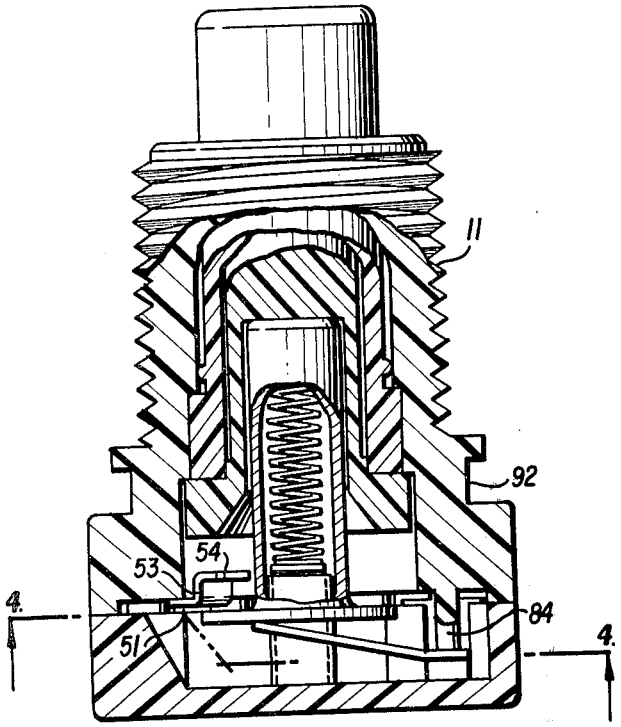
FIG. 3 is a cross-section through the switch housing taken along the lines 2—2 in FIG. 1.
Figure 4:
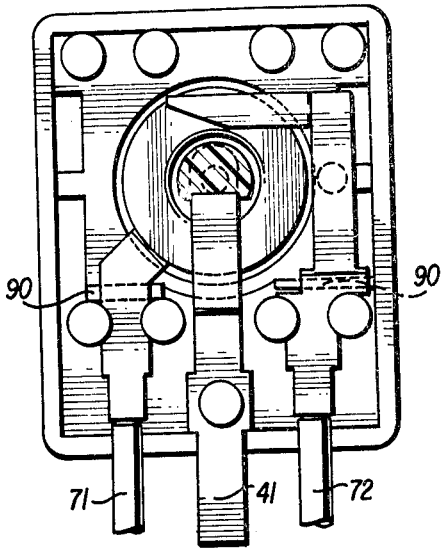
FIG. 4 is a cross-section through the head taken along the lines 3—3 in FIG. 3.
Figure 7A:
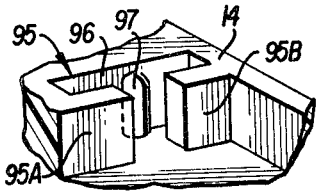
FIG. 7 is a sectional view of the cover portion of the switch of FIG. 1.
Figure 9:
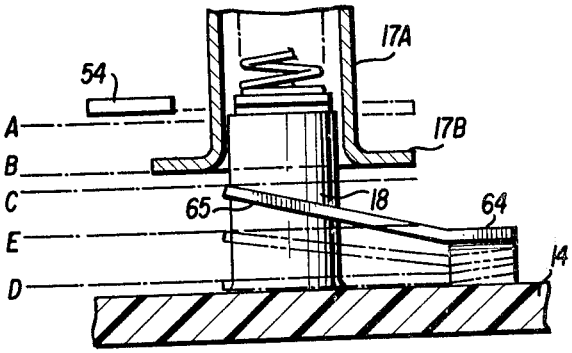
Figure 8:
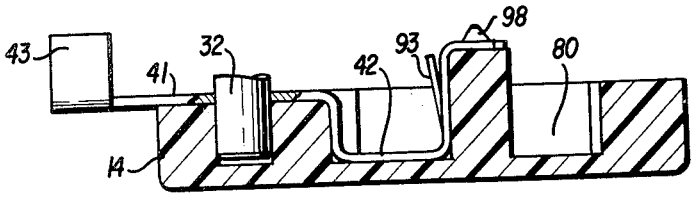

FIG. 8 is a partial cross-section of the cover member taken on the lines 5—5 in FIG. 7;

FIG. 9 is a partial blow-up of the cross-section of FIG. 3, with the plunger shown in the various positions attained following actuation of the switch; and FIGS. 10A and 10B show transverse and longitudinal views of a dog-leg contact terminal formed in accordance with the preferred embodiment.

BEST MODE FOR CARRYING OUT THE INVENTION

FIGS. 1 and 2 show perspective and exploded views, respectively, of a pushbutton switch formed in accordance with a preferred embodiment of the present invention. In particular, a separable switch housing 10 comprises a first housing member including an externally threaded, barrel-shaped portion 11 having a head portion 12 attached at one end thereof. The head portion 12 extends substantially transverse to an axis 13 which, in turn, extends longitudinally through barrel portion 11. The remaining housing member constitutes a cover portion 14 adaptable for positioning adjacent to head portion 12 during assembly of the switch.

The plunger and ratchet mechanism to be described is substantially similar to the ratchet mechanism located in the referred-to copending application Ser. No. 873,030 incorporated by reference thereto. A generally cylindrically-shaped plunger 15 is adaptable for sliding movement within barrel portion 11 along axis 13. Plunger 15 includes an end 15B available for selective engagement with an actuator in order to selectively project plunger 15 between retracted and projected positions spaced along axis 13. Fitted within plunger 15 is a generally cylindrically-shaped ratchet sleeve 16 which is also aligned for longitudinal movement along axis 13. Fitted within sleeve 16 is a movable contact 17 which is substantially thimble-shaped and includes a cylindrical portion 17A extendable within sleeve 16 and a flange portion 17B attached to one end of cylindrical portion 17A. Flange portion 17B extends in a radially outward direction from attached cylindrical portion 17A and serves to establish an electrical connection with one of two spaced contact terminals as will be described.

A guide stud 18 is attached to cover 14 and projects toward head 12 when switch 10 is in the assembled position shown in FIG. 1. Guide stud 18 has a substantially semi-circular configuration and is adaptable for projection into the cylindrical portion 17A of movable contact 17. Guide stud 18 further includes a longitudinally extending slot 18B which serves to locate a contact terminal as will be described. During assembly, a coil spring 19 is arranged within movable contact 17, with one end of spring 19 engaging an inner surface of cylindrical portion 17B and a further, opposite end of spring 19 supported on guide stud 18. Coil spring 19 serves to bias movable contact 17, sleeve 16 and plunger 15 into one of two stable positions corresponding to retracted and projected positions of contact 17.

Plunger 15 carries a plurality of circumferentially spaced lugs 15A, with four such lugs 15A being employed in the preferred embodiment. Each of the lugs 15A is adaptable for sliding in one of four extended recesses or ways 19A formed between pairs of adjacently disposed ribs or splines 20, wherein each rib 20 projects radially inwardly from an interior wall portion of barrel 11. Ribs 20 extend along barrel 11 in a direction parallel to axis 13, with alternatively disposed pairs of ribs forming the extended recesses 19A. Further, alternatively disposed pairs of ribs 20 form more shallow recesses or ways 19B, with each recess 19B positioned between a pair of recesses 19A. Furthermore, ribs 20 are each formed with diagonally extending shoulders which define camming ramps 21A, as best shown in FIG. 6. Alternate ribs 20 are also formed with camming ramp extensions 21B which extend across an adjacent shallow recess or way 19B, forming a plurality of circumferentially spaced latching pockets 22. Because the lugs 15A of plunger 15 are initially arranged within recesses 19A, plunger 15 is available for projection along axis 13 of barrel 11. However, contact between the lugs 15A and adjacently disposed ribs 20 forming recesses 19A prevent angular rotation of plunger 15 relative to axis 13.

Sleeve 16 is fitted with a plurality of circumferentially spaced latch dogs 16B which are adaptable for projection into either recesses 19A or 19B as will be described. Latch dogs 16B are formed with end portions each having a substantially sawtooth configuration defining camming ramps of similar configuration to the camming ramps 21A and 21B formed on ribs 20, with each latch dog camming ramp extending across an entire rear surface of the latch dog. Both plunger 15 and sleeve 16 further include circumferentially extending camming teeth mounted on exterior surfaces thereof, with camming teeth 22 mounted on plunger 15 facing similarly-shaped camming teeth 23 mounted on sleeve 16.

Referring to FIGS. 1, 5 and 6, it is noted that head portion 12 is formed with a plurality of spaced pin members, with nine pin members 24–32 being employed in the preferred embodiment. Pin members 24–32 extend substantially parallel to one another, with each pin member received within a separate recess 24A–32A correspondingly located in a confronting surface of cover 14. Pin members 24–32 are each structured to provide an interference fit with recesses 24A–32A, preventing inadvertent separation of head and cover portions 12 and 14 from their assembled positions. Furthermore, pairs of the pin members may be selectively located on opposite sides of contact terminals located within housing assembly 10 to prevent longitudinal misalignment and even withdrawal of the terminals as a result of stresses applied to electrical conductors attached to the terminals.

As noted in FIG. 2, a plurality of three contact terminals 40, 50 and 60 are each arranged between head and cover portions 12 and 14, respectively. Contact terminal 40 includes a substantially flat portion 41 and a substantially U-shaped portion 42 attached to an end of portion 41. Attached to an opposite end of flat portion 41 is a crimped end portion 43 which can be selectively attached to a conventional electrical conductor 70. In a like manner, contact terminals 50 and 60 each are adaptable for attachment to separate electrical conductors 71 and 72, respectively. Each of the contact terminals 40, 50 and 60 constitutes a stamped terminal electrically attached to a separate conductor. Alternatively, each of the contact terminals may constitute a coined end portion of one of the electrical conductors. If coined end terminals are employed, they may be formed from a single strand of tinned conductor wire which has been coined flat. Alternatively, each of the coined ends could be formed from a plurality of separate strands of tinned conductor wire which are tightly twisted together, over-tinned and coined flat.

As shown in FIG. 2, cover 14 includes a recess 80 which completely surrounds guide post 18. Cover 14 includes a pair of additional recesses 81 and 82 which are spaced from one another as well as from recess 80. A substantially rectangularly shaped shallow recess 83 extends between recesses 81 and 82 and engages recess 80. During assembly, the flat portion 41 of contact 40 is positioned in shallow recess 83, with the attached substantially U-shaped portion 42 extending into abuting relation with wall portions of recess 80. A side of the substantially U-shaped portion 42 is located within slot 18B of guide stud 18, with slot 18B serving to maintain contact 40 in its properly aligned position. A further end 44 of contact 40 extends across a top of guide stud 18 and provides a support surface for receiving biasing spring 19. Spring 19 serves to electrically engage contact terminal 40 with moveable contact 17. It is noted that portion 41 of contact 40 is formed with a through aperture 45 which is aligned with recess 32A of cover portion 41 when contact 40 is in its proper position. As a result, pin member 32 extends through aperture 45 prior to entering recess 32A, preventing withdrawal of contact terminal 40.

Contact terminal 50 includes a flat portion 51 having a crimped end 52 which is physically attached to conductor 71 as shown in FIG. 5. Contact terminal 50 further includes a contact portion 54 which extends in a plane substantially parallel to a plane including portion 51.

Finally, as shown in FIG. 3, an engaging portion 53 of contact terminal 50 extends between and integrally joins portions 51 and 54 to one another. Portion 53 is curved to conform to the shape of an inner surface of barrel 11. When assembled, portion 51 is positioned adjacent to head portion 12, with engaging portion 53 extending along barrel 11. Portion 54 is angled with respect to a plane extending transversely through the longitudinal axis of portion 51, such that portion 54 extends toward the interior of cylindrical barrel 11 along a radius thereof. Portions 51, 53 and 54 of contact terminal 50 are dimensioned to allow contact between contact portion 54 and movable contact 17 only when the plunger 15 and sleeve 17 are in their fully retracted positions, as will be explained in detail hereafter.

Referring to FIGS. 2, 7, 10A and 10B, contact terminal 60 is formed to include a flat portion 61 which extends adjacent to head portion 12 as shown in FIG. 7. An end 62 of flat portion 61 is crimped to allow for engagement with electrical conductor 72. The electrical junction between end 52 and electrical conductor 71 is positioned within recess 82. Contact terminal 60 includes a further portion 64 which extends substantially parallel to portion 61, with an engagement portion 63 extending between and engaging ends of portions 61 and 64. Portion 63 forms a substantially perpendicular angle with portion 61, as shown in FIG. 10A. However, portion 64 has been bent or angled to form less than a perpendicular angle with portion 63. In other words, the actual longitudinal axis X—X of portion 64 forms an appreciable angle $\alpha$ with an axis X′—X′ extending perpendicular to portion 63. Attached to a further end of portion 64 is a further, contact portion 65 which has a longitudinal axis Y—Y which forms a perpendicular angle with the longitudinal axis X—X of portion 64. In addition, portion 65 is also bent such that longitudinal axis Y—Y forms an appreciable angle $\beta$ with a plane Z—Z forming an extension of the contact surface formed between portions 64 and 65. The bent portions of contact terminal 60 serve to provide a biasing force for maintaining electrical contact between contact portion 65 and movable contact 17. When assembled, portion 61 is positioned adjacent to head portion 14, with engaging portion 63 contacting a side wall of recess 80. The juncture between portions 63 and 64 conforms to the juncture between the side and bottom walls of recess 80. However, portion 64 inclines away from abutment with recess 80, which would coincide with axis X′—X′ of FIG. 10A. Likewise, attached portion 65 also inclines away a further distance away from the bottom of recess 80 as shown in FIG. 3. Because portion 64 inclines away from a bottom surface of recess 80, portion 64 is free to twist about its longitudinal axis to reduce or absorb bending stresses transmitted from movable contact 17 to contact terminal 60 when contact 17 is in its fully projected position.

The specific deformations of various portions of contact terminal 60 serve to provide sufficient electrical contact pressure between contact terminal 60 and movable contact 17 as movable contact 17 reaches its fully projected position, without overstressing contact terminal 60. In particular, the unique arrangement of the various portions of contact terminal 60 allows for a combination of bending of portions 64 and 65 as well as a twisting of portion 64 which results in a lower overall stress level than could be obtained by bending alone. It is noted that head portion 12 includes a pin member 84 which engages and provides a positive stop to the movement of portion 64. Pin member 84 is dimensioned to engage portion 64 only when an end of contact portion 65 is in a plane intersecting flange portion 17B when contact 17 is in the stable projected position. Pin 84 prevents portion 64 and attached portion 65 from remaining in contact with cylindrical portion 17B of moveable contact 17 as the moveable contact travels towards its fully retracted position, thereby ensuring that the electrical connection existing between contact terminal 60 and moveable contact 17 is broken prior to establishment of an electrical connection between contact terminal 50 and moveable contact 17. Without stop pin member 84, the pre-biased portions 64 and 65 of contact 60 would tend to move toward contact 50 as moveable contact 17 moves toward its fully retracted position. As a result, the gap between contact terminals 50 and 60 would be reduced, leading to the undesirable condition wherein moveable contact 17 simultaneously engages both contact terminals 50 and 60.

During assembly, contact terminal 50 is positioned between a pair of spaced pin members 26–27, with the pins engaging a pair of grooves formed on opposite sides of portion 51 to prevent inadvertent withdrawal of contact terminal 50. In a like manner, contact terminal 60 is positioned between a pair of pin members 24–25, with the pins engaging a pair of grooves formed in opposite sides of portion 61, preventing withdrawal of contact terminal 60.

The operation of the plunger ratchet is disclosed hereafter with regard to FIGS. 2 and 9. It will be assumed that plunger 15, sleeve 16 and movable contact 17 are in a fully retracted, stable position, wherein lugs 22 of plunger 15 and latch dogs 16B are both located in the extended recesses 19A of barrel 11. This position corresponds to the position designated by line A in FIG. 9, wherein flange portion 17B of movable contact 17 electrically engages contact portion 54 of terminal 50. If it is further assumed that electrical conductor 70 is energized, an electrical circuit is established from conductor 70 through contact terminal 40, spring 19, movable contact 17, contact terminal 50 and electrical conductor 71.

It will now be assumed that end portion 15B of plunger 15 is projected an intermediate distance into barrel 11 corresponding to the distance between lines A and B in FIG. 9. At the position designated by line B, plunger 15, sleeve 16 and movable contact 17 have been moved an appreciable distance along axis 13, causing flange portion 17B to move out of electrical engagement with contact portion 54. At this point, the electrical circuit between conductors 70 and 71 has been broken. It is noted that flange 17B does not as yet engage contact portion 65 of contact terminal 60. Therefore, no electrical connection will exist between conductors 70 and 72. As the plunger is projected a further distance through barrel 11, it reaches the position designated by line C, wherein the flange portion 17B of movable contact 17 engages contact portion 65 of contact terminal 60. At this point, an electrical circuit is established between electrical conductors 70 and 72.

Plunger 15 is capable of further movement within barrel 11 until a position corresponding to line D is achieved. At this point, latch dogs 16B have come out of engagement with extended recesses 19A. The camming surfaces 22 and 23 of plunger 15 and sleeve 16 make camming engagement with one another. Because lugs 15A of plunger 15 remain in recesses 19A, plunger 15 is prevented from rotating. Engagement of camming surfaces 22 and 23 then forces sleeve 16 to rotatively index relative to plunger 15. This, in turn, aligns the latch dogs 16B of sleeve 16 with the ribs 20. If pressure is removed from plunger 15, spring 19 causes movable contact 17, sleeve 16 and plunger 15 to move toward their retracted position designated by line A. However, latch dogs 16B engage camming surfaces 21A of those ribs 20 which also include the extended camming surfaces 21B. As a result, latch dogs 16B are forced into the latch pockets 22, preventing further movement of plunger mechanism 15 as well as movable contact 17. At this point, designated by line E in FIG. 9, sleeve 17 is effectively stopped from further movement toward its retracted position, creating a projected, stable position of the plunger mechanism.

The plunger assembly as well as the contact terminals have been dimensioned to ensure that when plunger 15 achieves the projected stable position E, an electrical engagement exists between movable contact 17 and contact terminal 60. To return plunger 15 to its retracted stable position, plunger 15 must be once again depressed in the axial direction toward cover 14. As the plunger again reaches the projected position designated by line D, camming surfaces 22 and 23 engage one another, causing sleeve 16 to rotatively index to again align latch dogs 16B with extended recesses or ways 19A. When pressure is removed from plunger 15, spring 16 forces contact 17, sleeve 16 and plunger 15 toward the retracted stable position.

As movable contact 17 passes the position designated by line C, the electrical connection between movable contact 17 and contact terminal 60 is broken. Movable contact 17 continues within barrel 11 until it again reaches the retracted position shown by line A. Prior to reaching line A, no electrical circuit exists between conductor 70 and either of the conductors 71 or 72. Only when movable contact 17 actually reaches its rectracted stable position will the electrical circuit between contacts 17 and 50 be re-established. It is clear that the preferred embodiment of the present invention provides a switch assembly capable of breaking a first electrical circuit prior to establishing a further, different electrical circuit.

As shown in FIG. 5, a pair of rib members 90 are each attached to an interior surface of head portion 12, with rib members 90 each extending in a direction substantially transverse to the longitudinal axis of portion 61 of terminal 60 and portions 51 of contact terminal 50, respectively. Rib members 90 are each formed of a crushable material and each rib projects away from head portion 12 and extends substantially across the entire surface of portions 51 and 61 as head 12 is brought into engagement with cover 14. Because ribs 90 are each formed of crushable material, they are deformed when pressed against portions 51 and 61, respectively. As a result, the crushable ribs 90 bias or press contact terminals 50 and 60 into engagement with surface portions of cover 14. This means that each of the contact terminals can be accurately positioned within housing 10 even though the contact terminals vary slightly in size due to manufacturing tolerances. Furthermore, the extended length of the crushable rib contacting portion 61 of contact terminal 60 prevents portion 61 from twisting out of its properly aligned position as a result of stresses received from movable contact 17.

Referring now to FIG. 7A, a pocket 95 is formed on cover 14 in order to lock portion 63 of contact terminal 60 against any undesirable movement within housing 10. If portion 63 were to undergo movement, such movement would be effectively amplified with respect to the free contact portion 65 of terminal 60, causing sufficient misalignment of portion 65 to possibly render the entire switch assembly inoperable for multi-circuit actuation. Pocket 95 includes a pair of deformable lip portions 95A, and 95B which extend toward one another and define a gap of sufficient width so as to allow portion 64 of terminal 60 to pass therethrough. A back wall 96 of pocket 95 is formed with a nob 97 which extends outwardly therefrom. Nob 97 is substantially cylindrically-shaped and functions to bias or press portion 63 against lip portions 95A and 95B, thereby ensuring proper positioning of contact terminal 60 within recess 80. During assembly, pocket 95, crushable rib 90 and stop pin 84 each functions to maintain a portion of contact terminal 60 in its proper position within housing assembly 10. Even though specific contact terminals 60 may vary slightly in size from one another, the unique structure of the switch housing discussed hereabove ensures that the contact portion 65 of contact terminal 60 is properly positioned relative to movable contact 17.

As discussed hereabove, the unique stepped shaped of contact terminal 50 as provided by portions 51, 53 and 54 creates a sufficient gap between contact terminals 50 and 60 to ensure that the electrical circuit formed between contacts 17 and 60 is broken prior to establishing the electrical circuit between contacts 17 and 50. In comparison, a conventional flat spade electrical terminal would provide only about one-half the gap created by the present invention, greatly increasing the chances of contact 17 simultaneously engaging both of the contact terminals 50 and 60.

Turning to FIG. 8, it is noted that the contact terminal 40 is also uniquely constructed to provide a proper electrical connection with moveable contact 17. In particular, a wall of the U-shaped portion 42 includes a spring tab 93 which is inclined into the U-shaped recess formed by portion 42. Tab 93 engages an interior wall portion of moveable contact 17 in order to provide a further electrical passageway between contact terminal 40 and moveable contact 17, which passageway acts in parallel with the electrical passageway formed through spring 19. As a result, a sufficient portion of the electrical current is transmitted through spring tab 93 to prevent over-heating and premature failure of spring 19. A further, unique structural feature of contact terminal 40 is a cone-shaped projection 98 extending into spring 19 which serves to properly locate spring 19, with respect to post 18. In addition, projection 98 provides a good electrical connection with spring 19, while preventing spring 19 from jamming inside moveable contact 17.

Many modifications can be made to the preferred embodiments illustrated herein, which modifications will be obvious to those skilled in the art after reviewing this description. For example, while the terminal configuration illustrated herein has actually been employed in examples of switches that have been manufactured, it may well be preferable to have terminals projecting from other body locations or bent in various shapes for specific applications and additional plugs and recesses, for example, at the corners of head 12 and cover 14. While the barrel 11 is illustrated as carrying external threads which facilitates mechanical mounting of the switch, those skilled in the art will realize that this feature is not essential to the invention. For example, a circumferentially extending recess 92 can be formed in an outer surface of head 12 as shown in FIG. 3, wherein recess 92 is positionable within an opening formed in a support wall with the sides of recess 92 engaging opposite sides of the support wall. In view of the foregoing, the scope of the invention is to be defined by the claims appended hereto and not be the preferred embodiments discussed herein.

CROSS-REFERENCE TO RELATED APPLICATIONS

The present application relates to an on-on push-button switch assembly of the type disclosed in co-pending application entitled Multi-Circuit Switch Assembly having Ser. No. 099,043 filed on the same date as the present application by co-inventors Horace Judson Buttner and Arnold B. Nordstrom, with Horace Judson Buttner also being the inventor of the present invention. The subject matter of the co-pending application entitled Multi-Circuit Switch Assembly Ser. No. 099,043 is hereby incorporated by reference thereto.

I claim:

1. An assembly for accurately positioning a contact terminal within a switch housing, and comprising:

a housing assembly including first and second housing members having confronting surface portions at least a portion of which are disposed in abutting contact with one another;

moveable contact means arranged for projection along an axis extending through said switch;

contact terminal means arranged in a predetermined location in said switch housing for selective engagement with said moveable contact means when said moveable contact means is projected to a predetermined position along said axis;

at least one of said contact terminal means including a free end portion for contacting said moveable contact means and for deflecting as said moveable contact means moves towards one of said stable positions, said free end being connected with a further portion of said at least one contact terminal means, which further portion is fixedly mounted in said housing assembly at a sufficient distance from said free end to enable deflection of said free end; and a rib member formed of crushable material formed integral with at least one of said housing members and projecting from one of said confronting surface portions into contact with and across said further portion of said at least one contact terminal means, said rib member being crushed against said at least one contact terminal means for maintaining said contact terminal fixedly positioned between said housing members as said free end deflects.

2. An assembly according to claim 1, wherein said switch includes first and second contact terminal means, each including a free end portion for alternatively contacting said moveable contact means and for deflecting as said moveable contact means alternatively moves towards each of said stable positions, each of said free ends being connected with a further portion of one of the respective contact terminal means, which further portions are each fixedly mounted in said housing assembly at a sufficient distance from said respective free end to enable deflection of said respective free end; and a pair of separate rib members each formed of crushable material integral with at least one of said housing members and each rib member projecting from one of said confronting surface portions into contact with and across one of said further portions of said respective first and second contact terminal means, each of said rib members being crushed against one of said first and second contact terminal means for maintaining said first and second contact terminal means fixedly positioned between said housing members as said respective free end deflects.

3. An assembly for containing proper positioning of an electrical contact terminal within a switch housing, and comprising:

moveable contact means arranged for projection along an axis extending through said switch;

contact terminal means arranged in a predetermined location in said switch assembly for selective engagement with said moveable contact means when said moveable contact means reaches a predetermined position along said axis;

said contact terminal means comprising a plurality of attached portions, with at least two of said portions extending in at least one plane lying generally across the line of travel of said moveable contact means and having longitudinal axes forming a sufficient angle to one another whereby one of said portions, when deflected by said moveable contact means, can cause torsional strain in at least one of the remaining portions; and a pocket means arranged in said switch housing for enclosing and immobilizing a further portion of said contact terminal means to maintain said plurality of attached portions in said predetermined locations within said switch housing prior to deflection by said moveable contact means.

4. An assembly according to claim 3, wherein said pocket means includes a portion of a recess formed in said switch housing, which recess encloses at least a portion of said contact terminal means.

5. An assembly according to claim 4, wherein said pocket means comprises a side wall portion of said recess and a bottom wall portion of said recess engaging said side wall portion, said pocket means further comprises a pair of spaced, deformable lip portions attached to both said side wall and bottom wall portions of said recess, said pocket means further comprises a nob extending outwardly from the side wall portion of said recess and formed with a substantially cylindrical-shape for pressing said further portion of said contact terminal into abutment with said deformable lip portions, with a yet further portion of said contact terminal extending between and engaging each said deformable lip portions to immobolize the portion of said contact terminal located within said pocket means.

6. An assembly for maintaining accurate positioning of an electrical contact terminal within a switch assembly and comprising:

a moveable contact means arranged for projection along an axis extending through said switch assembly;

first contact terminal means arranged for selective electrical engagement with said moveable contact means only when said moveable contact means reaches a predetermined position along said axis;

second contact terminal means arranged for continuous electrical engagement with said moveable contact means to selectively provide an electrical circuit between said first and second contact terminal means; and a post member extending within a recess formed in said switch and including slot means arranged for receiving a portion of said second contact terminal means to maintain said second contact terminal means in proper alignment relative to said moveable contact.

7. An assembly according to claim 6, wherein said slot means comprises a generally rectangularly-shaped slot formed in an outer wall of said post member and having a longitudinal axis extending substantially parallel to longitudinal axis of said post member.

8. An assembly for maintaining proper electrical contact between a pair of relatively moveable electrical contacts arranged within a switch housing assembly, and comprising:

a moveable contact means arranged for projection along an axis extending through said switch, and having interior wall means extending about a space which is at least partially enclosed by said wall means;

a first contact terminal means positioned for providing substantially continuous electrical engagement with said moveable contact means, said first contact terminal means including a portion projecting into the space at least partially enclosed by said interior wall means of said moveable contact means, said portion having a spring tab extending into sliding engagement with said interior wall means to provide electrical connection therebetween; and a second contact terminal means positioned for selective engagement with said moveable contact means when said moveable contact means reaches a predetermined position along said axis.

9. An assembly according to claim 8, wherein said switch housing includes a post member extending through a recess formed in said housing, with said post member located in abutting contact with said portion of said first contact terminal means having said spring tab to maintain said spring tab in sliding engagement with said interior wall means of said moveable contact.

10. A pushbutton switch for electrically breaking a previously established electrical circuit between a pair of contact terminals prior to establishing a different electrical circuit between a pair of contact terminals, and comprising:

a housing including a barrel portion with an axis extending therethrough and a head portion attached to an end of the barrel portion, said head portion extending generally transverse to said axis;

a cover secured to said head portion with first, second and third separate contact terminals secured, in electrically non-contacting relation, between said head and cover;

a moveable contact projectable along said axis toward an end portion of said second contact terminal positioned on one side of said moveable contact, said moveable contact further being projectable in an opposite direction along the axis toward an end portion of said third contact terminal positioned on a further, opposite side of said moveable contact;

coil spring means extending between a portion of said first contact terminal and a surface of said moveable contact for biasing said moveable contact along said axis toward a predetermined stable position; and a projection member extending from said first contact terminal into said coil spring means for preventing inadvertent misalignment of said coil spring means relative to said first contact terminal.

11. An assembly according to claim 10, wherein said projection member has a substantially coincally-shaped configuration.

* * * * *